United States Patent [19]

Desourteaux

[11] 4,391,483

[45] Jul. 5, 1983

[54] SEALING SLEEVE FOR USE WITH ELECTRICAL CONNECTORS

[75] Inventor: Dominique E. Desourteaux, Epernon, France

[73] Assignee: Societe Anonyme Francelco, Suresnes, France

[21] Appl. No.: 245,493

[22] Filed: Mar. 19, 1981

[30] Foreign Application Priority Data

Mar. 28, 1980 [FR] France ..... 80 06963

[51] Int. Cl.[3] ..... H01R 4/00

[52] U.S. Cl. ..... 339/94 R; 339/223 R

[58] Field of Search ..... 339/60 R, 60 C, 60 M, 339/94 R, 94 A, 94 C, 94 L, 94 M, 223 R, 223 S, 276 R, 276 T, 218 R

[56] References Cited

U.S. PATENT DOCUMENTS

| | | | |
|---|---|---|---|
| 3,281,524 | 10/1966 | Lynch, Jr. et al. | 339/223 R X |
| 3,708,611 | 1/1973 | Dinger | 339/276 R X |
| 3,787,796 | 1/1974 | Barr | 339/60 R |
| 3,880,487 | 4/1975 | Goodman et al. | 339/60 R |
| 3,941,444 | 3/1976 | Bruni et al. | 339/60 M |
| 4,311,355 | 1/1982 | Plyler et al. | 339/94 R |

FOREIGN PATENT DOCUMENTS

| | | |
|---|---|---|
| 2415375 | 8/1979 | France . |
| 1283093 | 7/1972 | United Kingdom . |

*Primary Examiner*—Howard N. Goldberg
*Attorney, Agent, or Firm*—Sandler & Greenblum

[57] ABSTRACT

An improved sealing system for use with cooperating electrical connectors for placing two cables of the type wherein each of the cables has an insulator sheath in contact. A contact is inserted into a lodging in each of the connectors with a resulting space between the outer diameter of the insulator sheath and the inner diameter of the electrical connector. The sealing system includes:

(a) an electrical contact having a contact element and a tail portion, the tail portion being adapted to be crimped onto one of the cables; and (b) a flexible sealing sleeve molded onto the tail portion of the electrical contact, the sealing sleeve being adapted to seal the space.

3 Claims, 6 Drawing Figures

SEALING SLEEVE FOR USE WITH ELECTRICAL CONNECTORS

BACKGROUND OF THE INVENTION

1. Field of the Invention

The present invention relates to an improvement in devices adapted to assure the sealing of electrical connectors.

2. Description of Prior Art

An electrical connector is generally constituted, in its simplest form, of two parts made out of an insulating material; each enclosing a metallic element, or contact, connected to the end of an electrical conductor. By engaging the two parts in one another, the contacts are brought into electrical contact.

For numerous applications, it is important that the contacts be isolated from the atmosphere particularly if the atmosphere contains pollutants or is particularly humid.

Although the problem of sealing is simple enough to resolve with respect to the connection of the insulating parts, this problem is more delicate with respect to the cable inlets whose diameter is much greater than that of insulated cables.

In the present state of the art, the annular orifice between the inlet orifice of the insulating portion on the outer surface of the cable is blocked by a sleeve made of very soft synthetic rubber rendered integral with the tail of the contact by crimping.

This sleeve is engaged on the cable and positioned on the cable prior to the attachment of the cable to the tail of the contact. The tail is provided, for this purpose, with two supplemental crimp flaps analogous to those utilized for the attachment of the end of the cable on the contact.

This process is not satisfactory for a number of reasons. The sleeve must have a shoulder portion to allow for the crimping, which complicates the manufacture. Furthermore, the crimping of the sleeve is not possible except if it is very carefully positioned with respect to the exposed ends of the cable, which requires a supplemental operation prior to crimping. Yet further, the crimping complicates the manufacture of the crimping machines. Also, the attachment of the sleeve is very delicate by virtue of its extreme flexibility, so the crimping must be carried out with a high degree of precision.

In effect if the crimping is too strong, there is a risk of crushing the shoulder portions of the sleeve, causing it to split. But, if the crimping is too weak, the sleeve is not held and an expected action on the cable causes the escape of the sleeve out of its lodging.

SUMMARY OF THE INVENTION

The present invention overcomes the above disadvantages, and is remarkable in that the sealing sleeve is molded onto the end of the contact tail.

BRIEF DESCRIPTION OF THE DRAWINGS

The invention will be better understood from the description which follows given with reference to the annexed drawings by way of examples only, in which.

DESCRIPTION OF THE PREFERRED EMBODIMENTS

Figure 1:
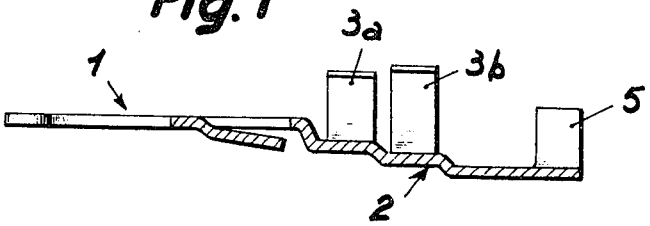
FIG. 1 is a cross-sectional view of one of the contacts of a conventional connector modified so as to receive the sleeve of the invention.
Figure 2:
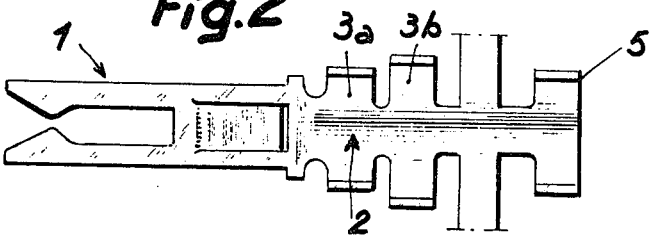
FIG. 2 is a top view of the device of FIG. 1.
Figure 3:
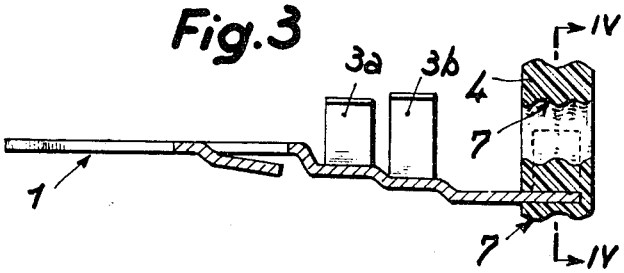
FIG. 3 is a view analogous to FIG. 1 showing a contact of the invention.
Figure 4:
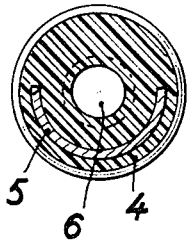
FIG. 4 is a cross-sectional view along line IV—IV of FIG. 3.
Figure 5:
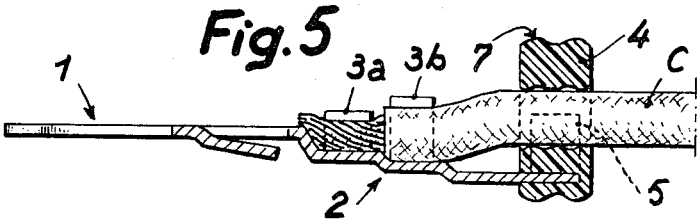
FIG. 5 is a view analogous to that of FIG. 3 showing the contact attached to the end of a cable.
Figure 6:
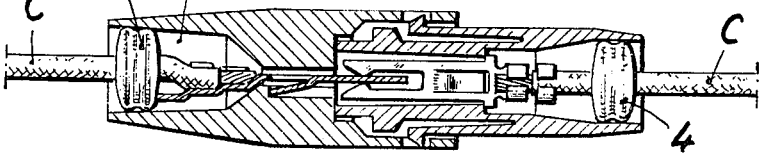
FIG. 6 is a cross-sectional view, on a smaller scale, showing the utilization of contacts of the invention in a conventional electric connector.

With reference to the drawings, it is seen that the electrical contact comprises two conventional parts 1 and 2. Part 1 constitutes the contact element, as it is called, while part 2 forms a tail on which the electric cable C is attached.

To this end, and in the usual fashion, the tail 2 has two pairs of flaps 3*a* and 3*b;* the flaps 3*a* being crimped on the exposed end of the cable C, while flaps 3*b* are crimped on the insulation of the said cable.

According to the invention a sealing sleeve 4 illustrated as a grommet having an inner orifice therein is molded over the end of the tail 2, extending beyond the flaps 3*b*. The sleeve 4 is made out of very flexible natural or synthetic rubber.

To this end and according to one embodiment of the invention, the end of the tail has an extension 5 appropriately cut away and cambered such that after molding of the sealing sleeve it is embedded in the sleeve and cooperates to keep it secured.

This process overcomes all the inconveniences cited with respect to the known sealing device recited above.

The outer diameter of the sleeve is greater than the inner diameter of the lodging L of the connector having to receive it and the diameter of central orifice 6 is slightly greater than that of the cable C.

In this way, the cable freely goes through the sleeve which, thus, does not interfere with the positioning of the cable prior to its attachment on the contacts. When the sealing sleeve penetrates the lodging L of the connector, the material constituting it compresses itself around the cable assuring its sealing.

To facilitate the deformation of the sealing sleeve, the inner and outer peripheries of the sleeve have annular grooves 7.

Although the invention has been described with respect to particular means and materials, it is to be understood that the invention is not limited to the particulars disclosed, and extends to all equivalents falling within the scope of the claims.

I claim:

1. An improved sealing system for use with cooperating electrical connectors for placing two cables in contact, each of said cables having an insulator sheath and being inserted in a lodging in one of said connectors with a resulting space between the outer diameter of said insulator sheath and the inner diameter of said electrical connector, said sealing system comprising:

(a) an electrical contact having a contact element and a tail portion, said tail portion being adapted to be crimped onto one of said cables;

(b) a flexible sealing sleeve molded onto the tail portion of said electrical contact, said flexible sealing sleeve being in the form of a cylindrical grommet with a concentric orifice therein, the outer diameter of said grommet being slightly less than the inner diameter of said lodging, and the diameter of said orifice being slightly greater than the outer diameter of said insulator sheath, wherein annular grooves encircle the outer peripheral surfaces of said grommet and said orifice, said sealing sleeve being adapted to seal the said space;

(c) said tail portion comprising means for further securing said sealing sleeve thereon.

2. The improved sealing system as defined by claim 1 wherein said sealing sleeve is made of natural or synthetic rubber.

3. The improved sealing system as defined by claim 1 wherein said means for further securing said sealing sleeve thereon are flaps embedded within said sealing sleeve.

* * * * *

UNITED STATES PATENT AND TRADEMARK OFFICE

CERTIFICATE OF CORRECTION

PATENT NO. : 4,391,483

DATED : July 5, 1983

INVENTOR(S) : Dominique E. DESOURTEAUX

It is certified that error appears in the above-identified patent and that said Letters Patent is hereby corrected as shown below:

Column 1, line 52, "expected" should read ---unexpected---.

Signed and Sealed this

Sixth Day of December 1983

[SEAL]

*Attest:*

GERALD J. MOSSINGHOFF

*Attesting Officer*

*Commissioner of Patents and Trademarks*